US006715517B2

(12) United States Patent
Tobin

(10) Patent No.: US 6,715,517 B2
(45) Date of Patent: Apr. 6, 2004

(54) PORTABLE SELF-CONTAINED UNIT FOR AND METHOD OF HANDLING POLLUTING LIQUIDS

(76) Inventor: Timothy J. Tobin, 4214 Rome West Rd., Chillicothe, IL (US) 61523

( * ) Notice: Subject to any disclaimer, the term of this patent is extended or adjusted under 35 U.S.C. 154(b) by 41 days.

(21) Appl. No.: 10/098,561

(22) Filed: Mar. 18, 2002

(65) Prior Publication Data

US 2003/0172986 A1 Sep. 18, 2003

(51) Int. Cl.[7] ..... B65B 1/04

(52) U.S. Cl. ..... 141/86; 141/311 A; 220/573; 184/106

(58) Field of Search ..... 141/86–88, 311 A; 220/573; 184/106

(56) References Cited

U.S. PATENT DOCUMENTS 4,114,644 A * 9/1978 Piper ..... 137/565.17
4,392,552 A * 7/1983 Partridge ..... 184/106
5,482,093 A * 1/1996 Tremonti et al. ..... 141/98
5,816,743 A * 10/1998 Schmitz, Jr. ..... 405/53
5,975,332 A * 11/1999 Bishop ..... 220/571
6,301,848 B1 * 10/2001 Whitaker ..... 52/302.1

* cited by examiner

*Primary Examiner*—Steven O. Douglas
(74) *Attorney, Agent, or Firm*—Paul H. Gallagher

(57) ABSTRACT

An all-steel platform having a fluid-proof floor member with a channel at one side leading into a sump at the end of the channel. Fluid from the floor member flows into the channel and sump, and a pump in the sump for recirculating the fluid into containers on or above the platform. The platform will support a mobile vehicle for receiving fluid for wheeling it to a garden for spraying it. The platform may be used for spray-cleaning articles thereon. The platform is normally stationary but can be moved for re-locating it.

14 Claims, 4 Drawing Sheets

HIGHLY EXAGGERATED

PORTABLE SELF-CONTAINED UNIT FOR AND METHOD OF HANDLING POLLUTING LIQUIDS

FIELD OF THE INVENTION

The invention resides in the broad field of handling polluting liquids. Such liquids consist particularly of chemicals and petroleum items, although it is applicable to any liquids having a polluting effect.

The apparatus of the invention is particularly useful in those operations where the liquids are transported by vehicles for use at a distant location. In such use, the vehicles are loaded at one location, and the liquids are carried to the distant location where a transfer of the liquids is made. This transfer may consist of applying liquid chemicals to a field, such as a golf course or a garden, and it may also include unloading the liquids into another receptacle.

Further, in such use of the apparatus, the liquids often are spilled on the ground or floor, which is incidental to their intended good use. The apparatus is operable for preventing pollution from such chemicals that are accidentally spilled.

In addition to accidentally spilling such polluting liquids, the liquids are in some cases so used that they are deliberately allowed to fall on the floor, as in rinsing and cleaning articles, and it is desired that the liquids in this case also be confined and collected to prevent pollution.

A broad object of the invention therefore is to provide apparatus and method for use in these general areas of operation so as to prevent pollution, and which include the broad steps of rinsing, reclaiming, and recycling.

More specifically, the apparatus is mainly in the form of a self-contained unit which includes a platform onto which a vehicle is driven, for loading it with the liquids for their intended use. In such loading, the liquids are accidentally spilled, in at least small amounts, and the apparatus has a means for catching all such spilled liquids, and reclaiming and recycling them. The vehicle is loaded on the platform and then transported to a field area, such as a golf course where liquid fertilizer is sprayed on the vegetation.

Another area in which the apparatus is used concerns petroleum items. Petroleum is a serious pollutant, both in the ground and in drain-off in sewers. In this case also, a vehicle is driven up onto the platform for loading, and then transported to a distant area for delivering the petroleum. In the loading step, any liquid that is spilled, is trapped by the platform, and later reclaimed. None of it is permitted to fall on the ground.

Another important feature is that the unit while normally stationary, can be moved from one location to another. In addition to the foregoing example of polluting the ground, polluting other areas also constitutes a serious situation. For example, heretofore in many instances, the polluting liquids were permitted to fall on a concrete floor, as in a rinsing or cleaning step, and such liquids ran off into the sewer, with serious contaminating effects. To prevent the pollution of the sewers, the liquids were collected from the concrete floor, so as to prevent their running into the sewer. However, this was not completely satisfactory because concrete is somewhat porous and the liquids correspondingly contaminate the concrete. Concrete floors very often crack, with open fissures running completely therethrough, and the liquids thus ran into the ground.

The apparatus can be made of any desired size to accommodate large vehicles as well as smaller items, and of various shapes to accommodate unusual space areas.

The self-contained unit includes a recirculating pump, for reclaiming the liquids that fall into a sump, and pumping them into a vehicle or other container.

Another feature is that the unit includes a storage tank so that the user may pump the liquids from the sump into the storage tank, and then at another time draining the liquids from the storage tank into a vehicle on the platform.

Still another important feature of the invention is that the platform may be used for storing containers filled with the liquids. For example, oil is often handled in drums, and brought into a service station or cleaning station, and deposited there for future use. The liquids are drawn out of the drums, or put into the drums, or both, and in this step the liquids may accidentally fall on the floor. The unit of the present invention can be used in such location, and such drums placed on the platform so that any liquids that do fall, find their way into the sump. Any such liquid, such as oil, is then recirculated and thereby recycled for further use.

BRIEF DESCRIPTION OF THE INDIVIDUAL FIGURES OF THE DRAWINGS

DETAILED DESCRIPTION OF THE DRAWINGS

Although the apparatus of the invention is to be used in different kinds of operations, it includes a single, basic unit.

Figure 1:
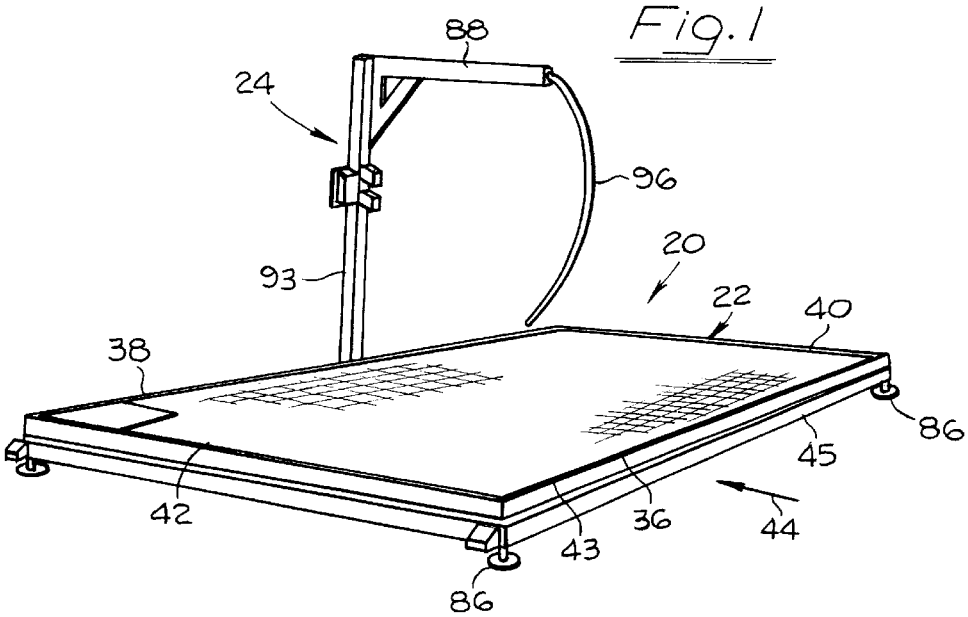
FIG. 1 is a perspective view of the basic form of the device of the invention.

Reference is first made to FIG. 1 showing this basic unit, in its entirety, indicated at 20, in perspective view. The unit 20 includes as main components, a platform 22, and a column 24. In the use of the device in one kind of operation, e.g. for spreading fluids or chemical fertilizers, a mobile spreader vehicle 26 (FIGS. 2, 3) is utilized, and is driven, i.e. wheeled, from the unit 20 to a garden, and in return. The spreading or spraying may be done on gardens, golf courses, or fields, for example; these areas may also be identified by the generic term substrate.

Figure 2:
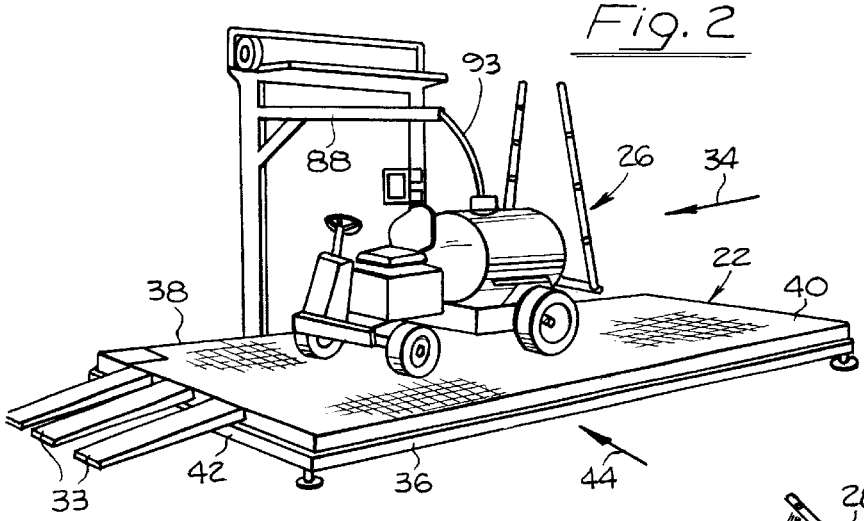
FIG. 2 is a view including the basic form of FIG. 1 and including a spraying vehicle thereon.
Figure 3:
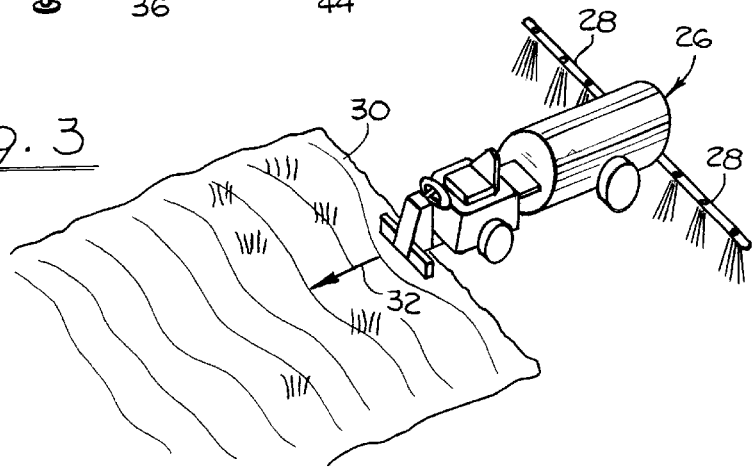
FIG. 3 is a perspective view of a spraying vehicle in relation to a garden to be sprayed.

FIG. 2 shows the vehicle 26 on the platform 22, in position to be filled and after it is so filled, it is driven to the garden for spreading the chemicals, as represented in FIG. 3. It includes spreader pipes 28 through which the chemicals are flowed and sprayed. A garden is indicated at 30, and the vehicle is driven into the garden as indicated by the arrow 32. After the spreader vehicle is thus emptied, it is returned to the unit 20 and refilled, and the operation repeated. Ramp means 33 is utilized for facilitating driving the vehicle onto the platform. In this operation, and other operations, the specific construction of the unit 20 is of importance, as described in detail hereinbelow.

Attention is directed to FIGS. 1 and 2 showing the various elements of the unit and their relative dimensions, or proportions. The platform 22 is preferably elongated, in side-to-side direction , for accommodating vehicles (e.g. 26) of substantial length, which are driven onto the platform in corresponding direction, indicated by the arrow 34 (FIG. 2). For convenience, the unit is oriented as observed according to the arrow 44 of FIGS. 1, 2, as having a front side 36, a rear side 38, a right side 40, and a left side 42.

Figure 6:
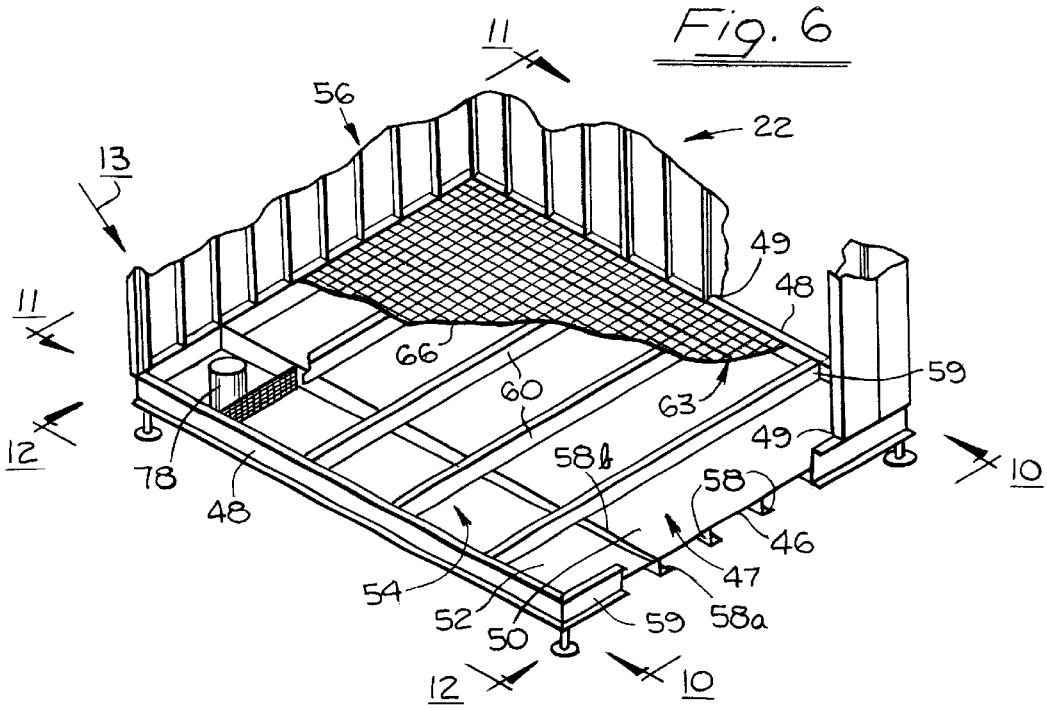
FIG. 6 is perspective view, partially broken away, of the platform of the unit.
Figure 10:
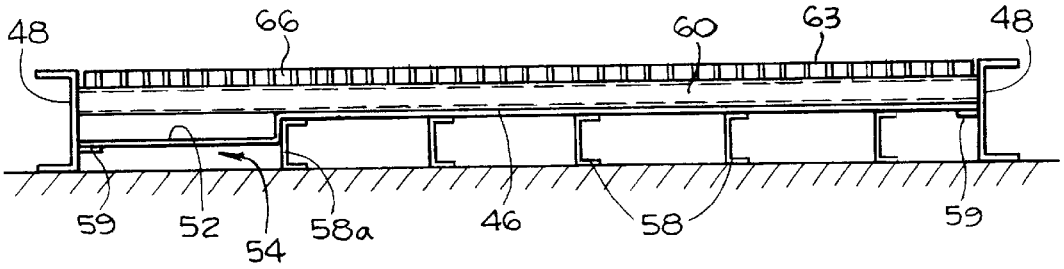
FIG. 10 is an elevational view from the front of the platform, as indicated by the line 10—10 of FIG. 6.
Figure 11:
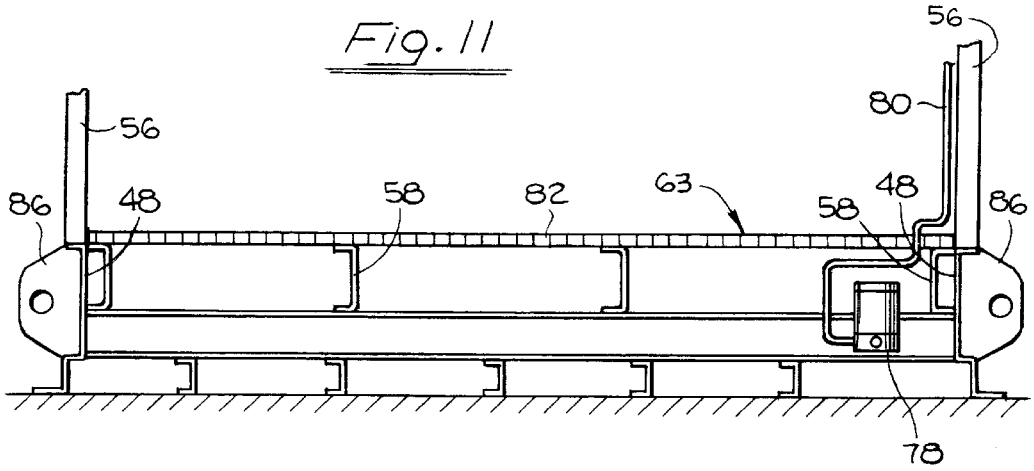
FIG. 11 is an elevational view from the rear of the platform, as indicated by the line 11—11 of FIG. 6.

In referring particularly to FIGS. 1 and 2, the platform 22 appears as an upper layer 43, and a lower layer 45. The upper layer constitutes the platform itself, and the lower layer is a steel framework supporting the platform. The entire unit, except for minor items such as fluid lines, instruments, etc. is made of steel, including stainless steel, with the parts respectively welded together in fluid tight connections. FIG. 6 shows the platform 22 almost in its entirety. It includes a floor member 46, consisting of a plate 47 extending throughout the dimensions of the platform. This may be a single sheet or several sheets welded together. Surrounding the floor member is a base strip 48 which also is shown in FIGS. 10 and 11.

Figure 12:
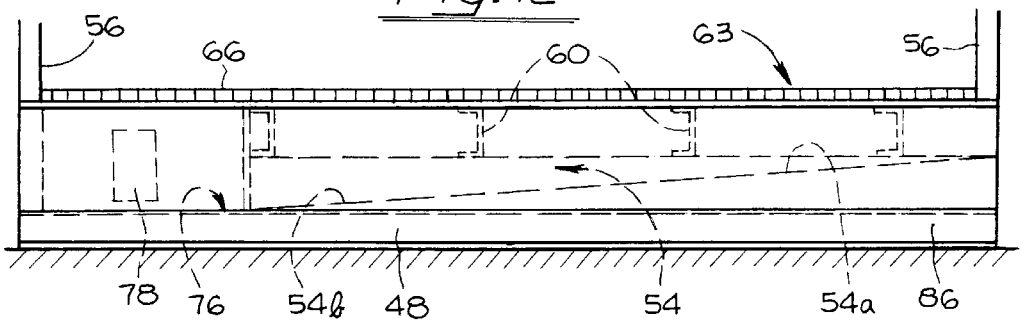
FIG. 12 is an elevation view from the left side of FIG. 6 as indicated by the line 12—12 of FIG. 6.

The plate 47 includes an upper main portion 50 and a lower portion 52 constituting the floor of a drain-off channel or gutter 54. The channel 54 thus is disposed at one side of the floor (the left side), and extends the full length of hat side, and it slopes downwardly from front to rear, as shown in FIGS. 6 and 12.

Figure 4:
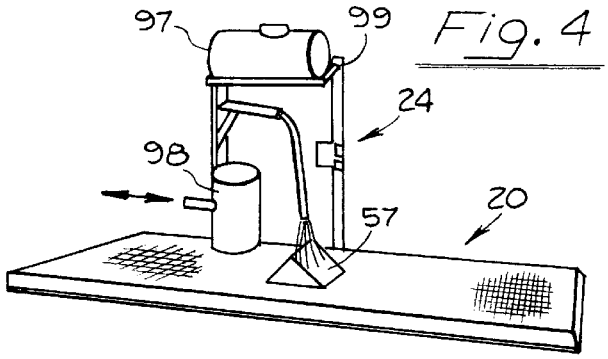
FIG. 4 is a view of the unit at an angle different from that of FIG. 2, without the spraying vehicle, but showing a storage tank in each of two alternative positions.
Figure 9:
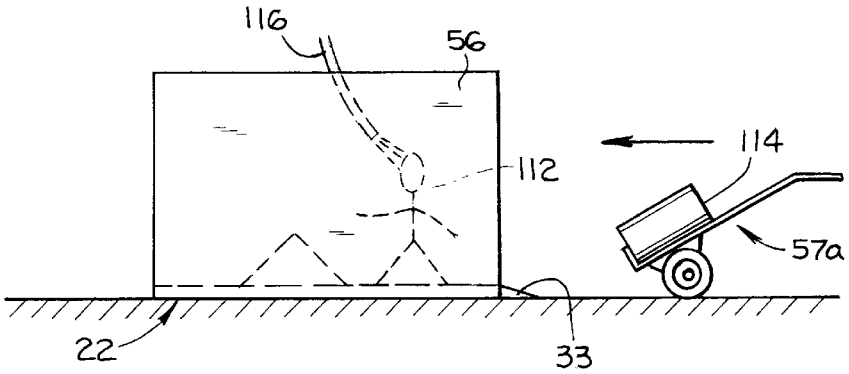
FIG. 9 is a side elevational view of an enclosure formed by the full wall that is partially shown in FIG. 6, and which is capable of enclosing the unit of FIG. 1.

The platform 22 may be provided with a surrounding wall 56 to form a confining enclosure for use in spraying fluid on an article 57 to be cleaned (FIG. 4). The article 57 which is also a substrate may be wheeled onto the platform by a cart 57*a* (FIG. 9). The wall is omitted when the apparatus is used for spreading the fluids, as in FIGS. 1–3. This wall is supported on and welded to the base strip 48 at 49.

The floor member 46 is secured to a plurality of transversely spaced channel supports 58 running from front to rear and secured to the floor member.

The plate 47 is secured at its side edges to the base strip 48 (FIG. 10) by known securing means 59, or by welding, and is bent down over the near support 58*a*, at 58*b*, to its lower level referred to.

Figure 7:
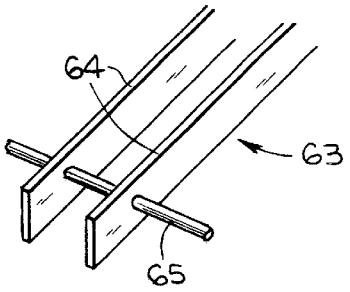
FIG. 7 is a detailed fragmentary view of the construction of the grating.
Figure 8:
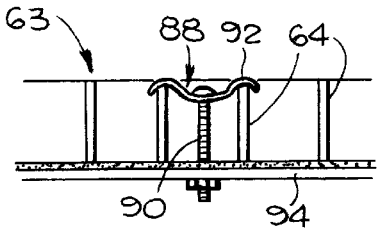
FIG. 8 is a detailed view of a hold-down means for the grating.
Figure 13:
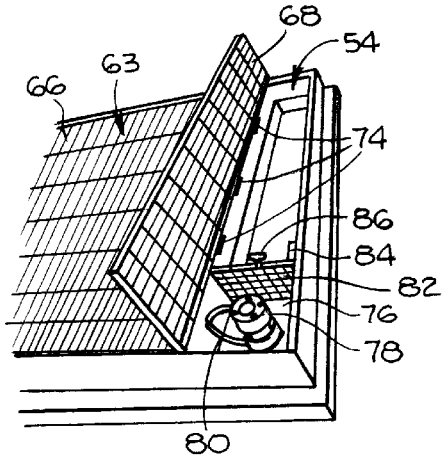
FIG. 13 is a perspective view oriented according to the arrow 13 of FIG. 6, and omitting portions of the platform.

Positioned on and secured to the plate 47 are a plurality of supports 60, running transverse to the direction of the supports 58 and thereby running lengthwise of the platform (FIG. 8). They are also secured at their ends to the base strip 48. Supported on the supports 60 (FIG. 6) is a web of grating 63. This grating is made up (FIG. 7) of a plurality of spaced parallel slats 64 mounted on transverse rods 65. This grating forms a web that extends throughout the area of the floor member and includes a larger portion 66 and a smaller panel or portion 68 (FIG. 13) hinged to the larger portion 66, as indicated at 74. The smaller segment covers the channel 54 and may be swung to open position, providing easy access to the channel to clean out the debris therefrom.

The channel 54 terminates in a sump, or basin, 76, in which is a liquid circulating pump 78, having electrical cables 80, for operating it. Between the sloping part of the channel, 54, and the sump 76, is a vertical screen, 82, vertically slidable in guide elements 84, having a handle means 86, for facilitating removing and replacing it, the screen being utilized for preventing trash from entering into the sump.

The platform is preferably positioned near level position but to assure that the fluid falling on the floor member 46 flows into the channel 54, the platform is provided with vertically adjustable feet 86 (FIG. 1) for raising the appropriate end of the floor member (i.e. the upper-right). These feet may be detachably incorporated in the platform to facilitate their removal in relocating the platform.

Figure 5:
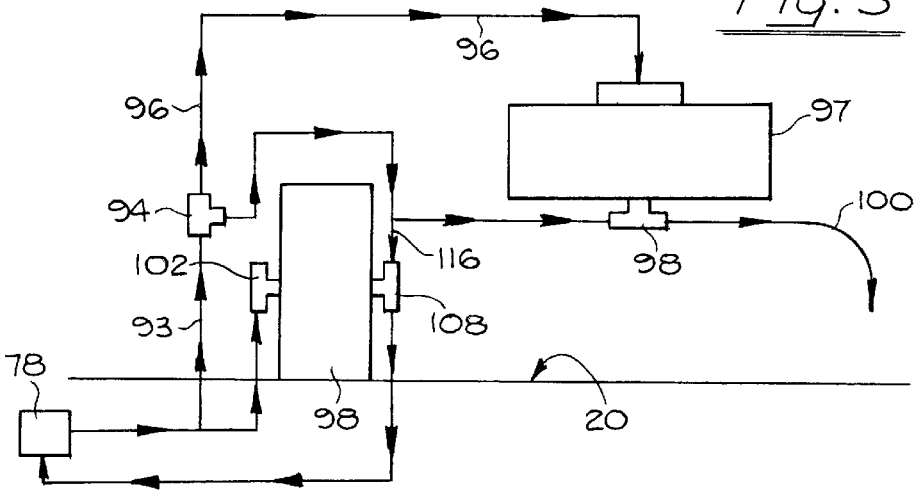
FIG. 5 is a diagram of fluid lines for conducting the fluids in the use of the apparatus.

Attention is directed to FIG. 5 showing a diagram which includes the fluid lines for directing the fluid for use in the apparatus. A liquid outlet line 93 (see also FIG. 1) leads from the pump over to the post 24 and then up the post, and at the top of the latter it follows a horizontal arm 94, pivoted on the post, and then extends beyond the outer free end of the arm, where it has a terminal outlet portion 96.

The system includes the use of one or more storage tanks 97, 98 (FIG. 4). While the vehicle 28 is used as referred to above on the platform, it may be desired in other usages to use one or more of the storage tanks 97, 98. A table 99 is provided for the tank 97, while the tank 98 is shown resting directly on the platform.

Referring again to FIG. 5, the outlet line 93 leads to a 3-way valve 94, from which leads a branch line 96 which continues to the upper storage tank 97. In the use of the storage tank, a supply of fluid may be provided in a separate vehicle, and when it is desired to use fluid in that tank, the fluid is able to run out through another 3-way valve, 98, and alternatively permitted to flow through the outlet line 100. This line 100 is enabled to empty into the vehicle 26 as referred to above. For utilizing the supply tank 98 instead of the tank 97, the 3-way valve 94 is adjusted to conduct the liquid from the outlet branch 93 to another 3-way valve 102, and then the outlet line 100 to another line 106, which leads to another 3-way valve 108.

FIG. 11 shows the surrounding wall 56 resting on the base strip 48 and secured thereto. Eyelets 86 (FIG. 7) are provided and secured to the base strip, for facilitating lifting the platform.

FIG. 12, which is a side view of FIG. 6 shows the drain-off channel 54, when it is seen that the front end at 54*a* is higher than the rear end 54*b* showing the slope into the sump. Also shown in FIG. 12 is the pump 78, disposed in the sump.

In addition to spreading fertilizers on the ground, the device is very useful without the vehicle for cleaning and rinsing various objects and items. Oil trucks in hauling oil in a simple operation of transferring it, become covered or partially covered by oil and need cleaning periodically. For this kind of cleaning, suitable fluids are sprayed onto the truck for washing off that oil. This step is performed in an enclosure, represented in FIG. 9 which confines the cleaning fluid from being thrown outwardly beyond the unit. Additionally, an operator may find his clothes contaminated, and wishes to wear a protective suit, which itself can be cleansed as represented in FIG. 9, where an operator 112 uses the cleaning fluid for cleaning his protective suit.

The apparatus is very effective in simply storing fluids. For example, oil drums are often stored in various situations, such as in garages and filling stations and spilled liquid is recycled.

Figure 14:
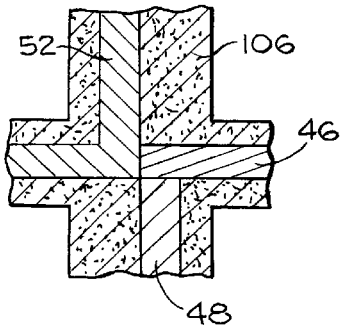
FIG. 14 is a cross-sectional detail view of elements of construction of the unit.

Another feature of the invention is that the structure of the unit is such as to prevent and substantially eliminate deterioration of the structural pieces of the unit. Attention is directed to FIG. 14 where portions of steel elements 46, 48, 52, are shown with coatings of paint 106 (highly exaggerated). The device is constructed of stainless steel and it is coated with a paint 116, designed to withstand any kind of pollutants. It is understood that even a minute hole or fracture in the paint would enable the chemicals to attack the metal. Even a small hole or fracture would eventually result in such deterioration over a great area. It is also essential that there be no holes leading from the interior of the structure to the exterior, resulting in unplanned pollution. This latter point is given extraordinary attention in the present case, considering that the platform is made up of steel pieces secured together, and although this is done by welding, which ordinarily would eliminate any small holes or cracks, nevertheless, the painting or covering of the stainless steel in the unit is of great thickness to prevent any accidental non-covering.

While the tank 97 or 98 provides a substantial storage capacity, the sump itself acts as a reservoir, at least to a substantial extent, in that the liquids in the sump may be recirculated in a rinsing operation.

Another advantage of the invention is that a liquid may be carried to the unit in a low vehicle, that is too low to drain by gravity into a container on the platform. In this case also, in the unlikely event that another pump is not present for pumping from the low vehicle into a high container or vehicle, it can be drained by gravity into the sump, and then pumped to the higher container, such as storage tanks or a vehicle, by the pump 78, in the sump.

FIG. 8 shows a hold down element 88 which may be a shank 90 and side hooks 92. The shank is extended through the grating and secured in a frame element 94, with the side hooks engaging the grating.

The platform can be moved from place to place by any desired and suitable means such as providing hooks on a crane and lifting the platform by means of the lifting eyelets 86.

The grating section 63 (FIG. 13) may be lifted for removing trash. This top screen panel, upon removal, also enables access to the pump.

The use of the storage tank is an obvious advantage in that the pump need not be operated in every instance in transferring liquid to the vehicle, or in other uses. The transfer may be done without operating the pump, by merely transferring liquid by gravity, feed from the storage tank to the point of use.

I claim:

1. Apparatus for handling polluting liquids, including, a self contained unit normally stationary but capable of being moved between different locations, a platform capable of supporting an article adapted for receiving the liquids, the platform including an imperforate floor member extending throughout the outline dimensions of the platform, the floor member having a channel extending along one side of the floor member, and a sump at one end of the channel, and the channel sloping downwardly into the sump and the unit also including a web of perforate grating covering the entire floor member and detachably secured to the platform.

2. Apparatus according to claim 1 and including, adjusting means for adjustably positioning the apparatus so that liquid on the platform runs into the channel.

3. Apparatus according to claim 2 wherein, the floor member is made up of a single, one-piece steel member.

4. Apparatus according to claim 1 and including, a liquid pump in the sump the pump thereby being covered by the grating and integrated in the self-contained unit.

5. Apparatus according to claim 1 and including, a post on the platform for supporting a table thereon at an elevated position, fluid lines operably connected with the pump and leading to said position of said table.

6. Apparatus according to claim 5 wherein, the platform is capable of supporting a mobile vehicle for receiving fluid, and, the platform includes a table for supporting a fluid container adjacent to said elevated position.

7. Apparatus according to claim 6 and including, valve means in the fluid lines operable for directing flow of fluid from the pump in the sump to any of the containers on the platform, and also for directing fluid flowing by gravity from any container on the platform to any other container therebelow.

8. Apparatus according to claim 3 wherein, the floor member also includes the floor of the channel.

9. Apparatus according to claim 1 wherein, the platform having a transverse longitudinal direction and having a front side and a rear side, the channel being positioned across one end of the platform, from front to rear, the platform having a vertical surrounding rim, and lower elongated support beams spaced in longitudinal direction and extending from front to rear, the floor member being supported by the lower support beams, the platform also including upper elongated support beams, transverse to the lower support beams and supported on the floor member, the lower support beams, the floor member, and the upper support beams being secured to the surrounding rims to form a rigid article.

10. Apparatus according to claim 9 wherein, the grating has a hinged portion covering the channel capable of being raised for exposing the channel.

11. Apparatus according to claim 9, and including a vertical screen removably positioned between the channel and the sump.

12. A method of treating polluting liquids comprising, providing a platform capable of confining liquid, providing a sump attached to the platform and positioned for receiving liquid flowing from the platform, providing a pump in the sump.

placing a substrate on the platform, pump liquid from the sump and applying it to the substrate, and enabling any such liquid that is spilled on the platform to flow into the sump, and thereafter pumping the liquid from the sump into a container.

13. A method according to claim 12 wherein, the substrate is an article to be rinsed, the liquid is sprayed onto the article and enabled to run off the article onto the platform.

14. A method according to claim 12 wherein, the substrate is a vehicle that includes a container, the method includes the step of filling the container in the vehicle with the liquid and in this step enabling any spilled liquid to fall on the platform, and transporting the vehicle to an area of ground and spraying the liquid in the tank onto the ground.

* * * * *